US010890135B2

(12) United States Patent
Suda

(10) Patent No.: US 10,890,135 B2
(45) Date of Patent: Jan. 12, 2021

(54) PISTON FOR INTERNAL COMBUSTION ENGINE

(71) Applicant: SUZUKI MOTOR CORPORATION, Hamamatsu (JP)

(72) Inventor: Naoyuki Suda, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 16/567,887

(22) Filed: Sep. 11, 2019

(65) Prior Publication Data

US 2020/0095952 A1 Mar. 26, 2020

(30) Foreign Application Priority Data

Sep. 25, 2018 (JP) ..... 2018-178850

(51) Int. Cl.

| | |
|---|---|
| ***F02F 3/10*** | (2006.01) |
| ***F02F 3/00*** | (2006.01) |
| ***F02F 3/02*** | (2006.01) |
| *F01C 1/04* | (2006.01) |

(52) U.S. Cl.

CPC ..... *F02F 3/10* (2013.01); *F02F 3/0076* (2013.01); *F02F 3/022* (2013.01); *F02F 3/027* (2013.01); *F01C 1/045* (2013.01); *F02F 3/105* (2013.01)

(58) Field of Classification Search

CPC .. F02F 3/10; F02F 3/0076; F02F 3/022; F02F 3/027; F02F 3/105

See application file for complete search history.

(56) References Cited

U.S. PATENT DOCUMENTS

| | | | | |
|---|---|---|---|---|
| 3,319,535 | A | 5/1967 | Holcombe | |
| 5,076,225 | A * | 12/1991 | Tokoro | F02F 3/00 123/193.1 |
| 6,357,341 | B1 | 3/2002 | Watanabe et al. | |
| 6,883,418 | B1 * | 4/2005 | Greiner | F02F 3/0084 92/169.1 |
| 2004/0094034 | A1 | 5/2004 | Oversby et al. | |
| 2016/0348611 | A1 * | 12/2016 | Suda | F02F 3/022 |

FOREIGN PATENT DOCUMENTS

| | | |
|---|---|---|
| DE | 60124748 T2 | 9/2007 |
| JP | H11-303674 | 11/1999 |

* cited by examiner

*Primary Examiner* — Syed O Hasan
(74) *Attorney, Agent, or Firm* — Cozen O'Connor

(57) ABSTRACT

[Problem to be Solved] A space from a skirt to a side wall is uniformly deformed in a wide range without a bias.

[Solution] A piston 1 has two pin bosses 3 disposed so as to face each other at an interval, a side wall 4 disposed on both sides of the pin boss 3, and a skirt 5 provided continuously to the side wall 4, and a pin hole 3*a* into which a piston pin 1a can be inserted is formed in the pin boss 3. Inner walls 10 of the side wall 4 and the skirt 5 are continuous with each other and disposed by facing on both sides of a pin boss axis C1 with the pin boss axis C1 between them. A horizontal section of the inner wall 10 is formed along a specific oval shape E.

6 Claims, 7 Drawing Sheets

PISTON FOR INTERNAL COMBUSTION ENGINE

TECHNICAL FIELD

The present invention relates to a piston for an internal combustion engine.

BACKGROUND ART

A piston for an internal combustion engine is a device for converting a combustion pressure to a rotary force of a crank shaft through a piston pin mounted on a pin boss and the like. As disclosed in Patent Literature 1, for example, the piston has a skirt on both sides of the piston pin boss in order to transmit a thrust force generated by the combustion pressure and inertia of the piston and the like in a distributed manner. Moreover, the skirt and the pin boss are connected by a side wall.

Sliding between the piston and the cylinder is occurs on the skirt. When combustion pressure is applied, the skirt is deformed to an inner side in a radial direction toward a piston center, and the side wall is deformed toward an outer side in the radial direction. Since the piston has a degree of freedom of rotation around a piston-pin center axis, when the skirt is deformed to the inner side, the piston is rotated and tilted.

CITATION LIST

Patent Literature

[Patent Literature 1] JP H11-303674 A

SUMMARY OF INVENTION

Problem to be Solved by the Invention

In the aforementioned example, there is a change point on a ridge line of the side wall and the skirt on a piston inner surface at which a change in a curvature is large. At the change point, concentrated deformation is generated on the skirt when the combustion pressure is received, the skirt is deformed toward the piston center, the piston is tilted, and a friction loss is likely to occur.

When the combustion pressure is received, with regard to the side walls on a lower end side of the piston, they are deformed to outer side direction of the piston (a direction from the piston center toward the outer side), and the closer they are to the skirt lower end, the more the deformation regions of the side walls are widened to the outer side direction in an inverted V-shape, whereby the piston is tilted, and the friction loss occurs. Thus, there has been room for improvement in bending rigidity of the skirt and the side walls.

The present invention was made in order to solve the aforementioned problem and has as an object to provide a piston for an internal combustion engine which can suppress tilting of the piston and can reduce the friction loss by enabling uniform deformation from the skirt to the side walls in a wide range without a bias and by reducing a deformation amount to the piston outer-side direction of the side walls on the piston lower end side.

Means for Solving the Problem

A piston for an internal combustion engine according to the present invention in order to achieve the object has two pin bosses provided on a lower side surface of a piston head and disposed so as to face each other at an interval, a side wall provided on the lower side surface of the piston head and disposed on both sides of each of the pin bosses, and a skirt provided continuously to the side wall, and a pin hole into which a piston pin extending horizontally can be inserted is formed in each of the two pin bosses. In the piston for the internal combustion engine, inner walls of the side wall and the skirt are continuous with each other, the inner walls are disposed by facing each other on both sides of a pin boss axis with the pin boss axis connecting centers of the two pin holes between them, and a horizontal section of each of the inner walls is formed along a specific oval shape.

Advantageous Effect of Invention

According to the present invention, the skirt to the side walls can be uniformly deformed over a wide range without a bias, the deformation amount to the piston outer-side direction can be reduced and the tilting of the piston can be suppressed in the side walls on the lower end side of the piston.

BRIEF DESCRIPTION OF THE DRAWINGS

FIG. 6 FIGS. 6A-6C are sectional views of FIG. 1, in which FIG. 6A illustrates a B1-B1 section in FIG. 1, FIG. 6B illustrates a B2-B2 section, and FIG. 6C illustrates a B3-B3 section.

FIG. 8 FIGS. 8A-8C are sectional views illustrating a variation of the horizontal section in FIG. 2, in which FIG. 8A illustrates a section of an upper part of a skirt, FIG. 8B illustrates a section below FIG. 8A, and FIG. 8C illustrates a section below FIG. 8B.

MODE FOR CARRYING OUT THE INVENTION

Figure 1:
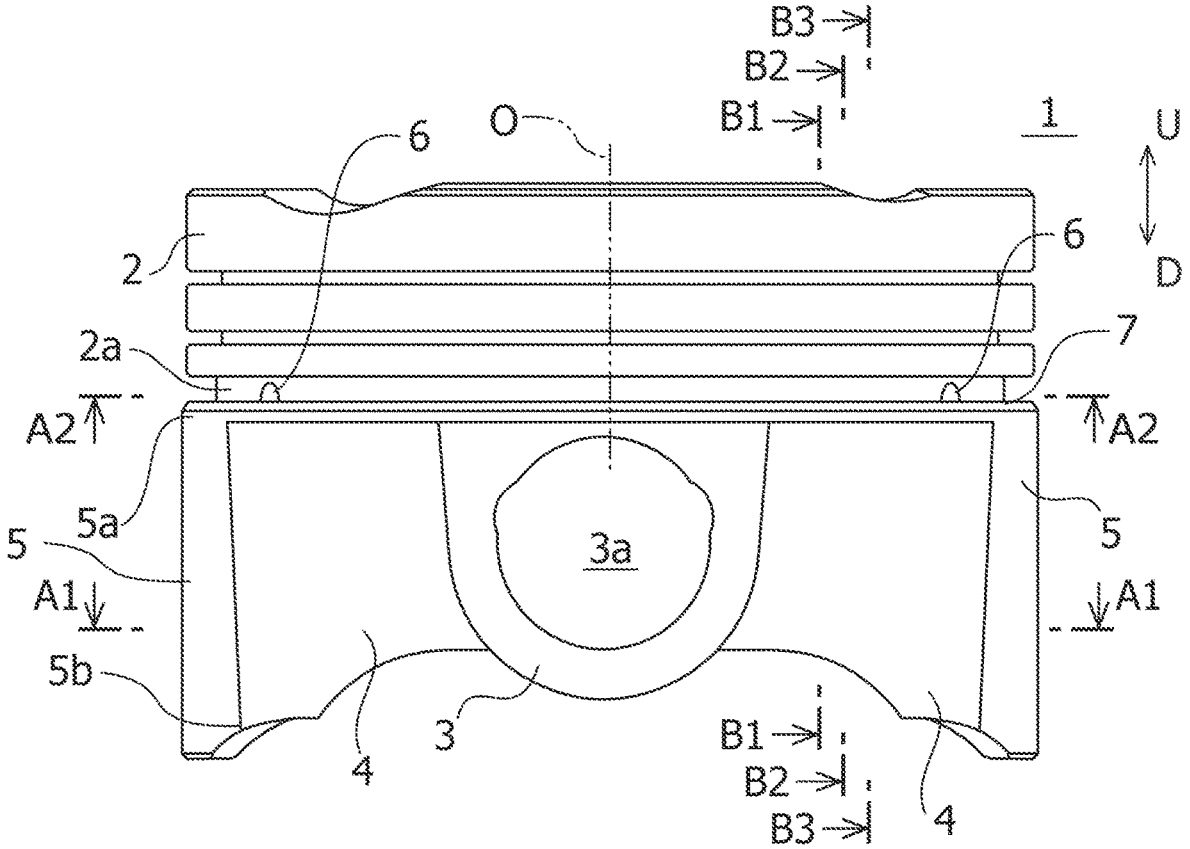
FIG. 1 is a front view of a piston for an internal combustion engine according to the present invention.

Hereinafter, an embodiment of a piston 1 for an internal combustion engine according to the present invention will be described by referring to the drawings (FIGS. 1 to 7). In the figures, an arrow U indicates upward, and an arrow D indicates downward. Moreover, a piston center O indicates a center of a circular piston head 2, and a piston radial direction indicates a radial direction of the piston head 2.

The piston 1 in this embodiment has two pin bosses 3 provided on a lower surface of the piston head 2 and disposed so as to face each other at an interval, a side wall 4 provided on a lower side surface of the piston head 2 and disposed on both sides of each of the pin bosses 3, and a skirt 5 provided continuously to the side walls 4. Moreover, a pin hole 3*a* into which a piston pin 1*a* extending horizontally can be inserted is formed in each of the two pin bosses 3. In the piston 1 for the internal combustion engine, inner walls 10 of the side walls 4 and the skirt 5 are continuous with each other, and the inner walls 10 are disposed by facing each other on both sides of a pin boss axis C1 with the pin boss axis C1 connecting centers of the two pin holes 3*a* between them, and a horizontal section of each of the inner walls 10 is formed along a specific oval shape E. Hereinafter, each portion will be described.

The piston head 2 has a cylindrical shape as illustrated in FIG. 1, and an oil ring groove 2*a* is formed on an outer peripheral portion.

Figure 2:
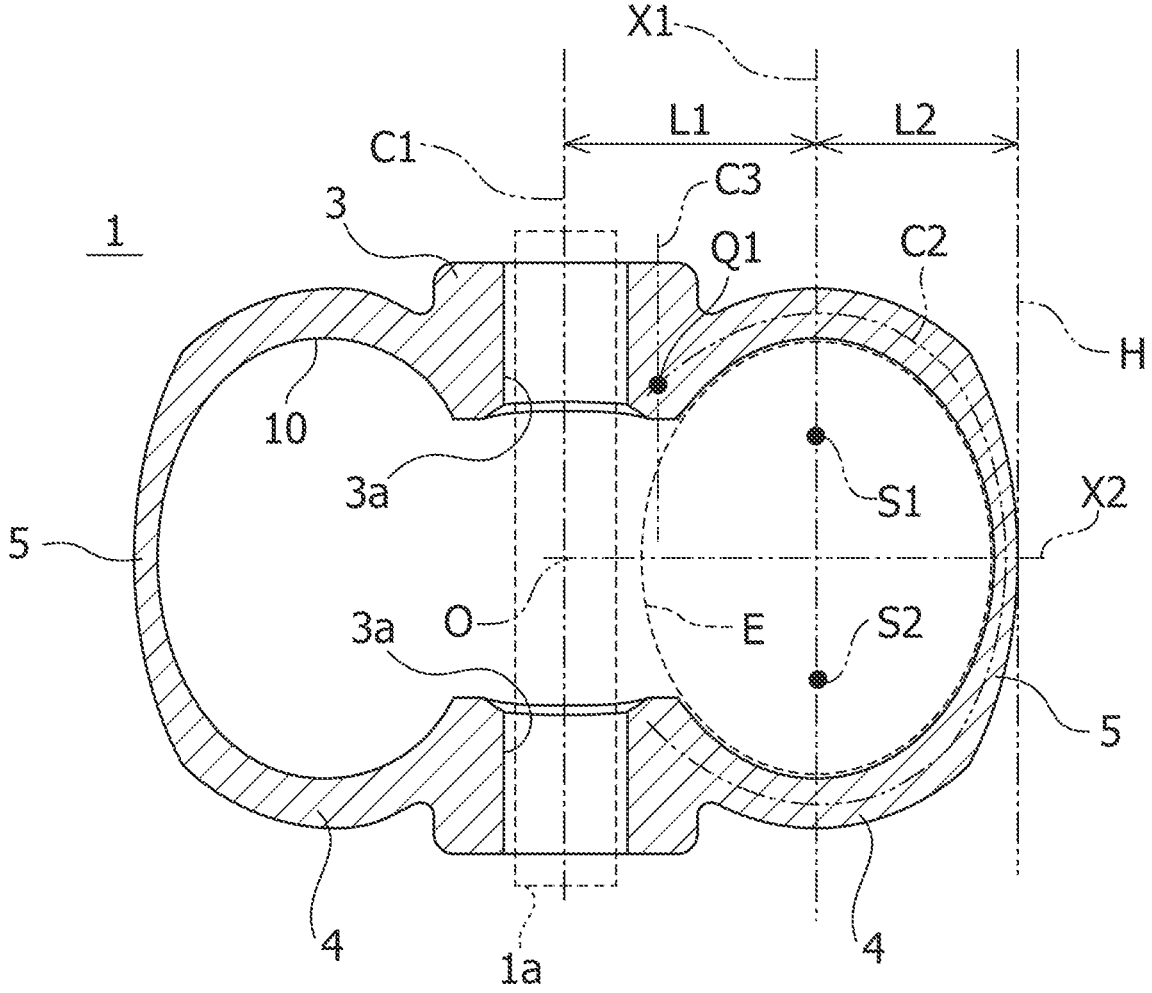
FIG. 2 is an A1-A1 sectional view of FIG. 1.

The two pin bosses 3 are disposed in the vicinity of an outer periphery of the piston 1 at an interval from each other with a piston center O between them as illustrated in FIGS. 1 and 2. A pin hole 3*a* penetrating in the radial direction of the piston 1 is provided in each of the two pin bosses 3. The piston pin 1*a* can be inserted into the two pin holes 3*a*.

The two pin holes 3*a* are disposed so as to face each other as illustrated in FIG. 2. The pin boss axis C1 is defined as a straight line connecting the hole centers of the facing pin holes 3*a* as described above. The piston pin 1*a* extends horizontally along the pin boss axis C1.

Each of the pin bosses 3 protrudes downward from the lower surface of the piston head 2, and a curved surface with a predetermined curvature is formed on a lower part of the pin boss 3. Moreover, both side portions of the pin hole 3*a* (side portions disposed in a direction orthogonal to the pin boss axis C1) have a predetermined wall thickness (thickness in the direction orthogonal to the pin boss axis C1).

The side wall 4 extends along the outer periphery of the piston 1 from the side portion of the pin boss 3 as illustrated in FIG. 2, and a curved surface having a predetermined curvature is formed on an outer side portion of the side wall 4. The side wall 4 is provided on both sides of each of the pin bosses 3. That is, the side walls 4 continuing to each of the pin bosses 3 are disposed by facing each other. An inner wall 10 of the side wall 4 will be described later.

The skirt 5 is provided along the outer periphery of the piston 1 continuously so as to connect the facing side walls 4 as illustrated in FIG. 2. The skirt 5 is disposed on the both sides with the pin boss axis C1 between them. That is, the two skirts 5 are disposed by facing each other with the pin boss axis C1 between them. On an outer side portion of the skirt 5, a curved surface having a predetermined curvature different from the curvature of an outer surface of the side wall 4 is formed.

The inner walls 10 of the side walls 4 and the skirt 5 are continuous with each other as illustrated in FIG. 2. In detail, the inner walls 10 of the facing side walls 4 and the inner wall 10 of the skirt 5 connecting them continuously with each other. The inner walls 10 are disposed by facing each other on the both sides of the pin boss axis C1 with the pin boss axis C1 between them as described above. The horizontal section of the inner wall 10 is formed along a single defined specific oval shape E. In this example, the oval shape E is disposed on both sides of the pin boss 3 and extends along the pin boss axis C1.

By forming the inner wall 10 along the specific oval shape E as described above, elimination of a change point where the curvature extremely changes on the ridge line of the inner surface on a boundary between the skirt 5 and the side walls 4 is realized.

Moreover, in comparison between an oval contained in a certain region and a circle contained in a similar region (a circle having a short axis of the oval as a diameter), by comparing a deformation region when a compression force is applied on the oval short-axis direction with a deformation region when the force is applied in the radial direction of the circle, the deformation region of the oval is wider than the deformation region of the circle. That is, deformation is possible in a wide range from the skirt 5 to the side walls 4 in this embodiment.

Moreover, when the combustion pressure is received, both the skirt 5 and the side walls 4 can receive the combustion pressure in the wide range and thus, a space from the skirt 5 to the side walls 4 can be uniformly deformed in the wide range without a bias. As compared with the case in which there is the change point of the curvature as above, occurrence of deformation concentrated on the skirt 5 side can be suppressed.

Moreover, the deformation amount of the skirt 5 in the direction toward the piston center O can be reduced. As a result, tilting of the piston 1 can be suppressed. Furthermore, a planar pressure of the cylinder acting on the skirt 5 can be reduced, friction resistance can be reduced, and a friction loss can be reduced.

Moreover, since the horizontal section of the inner wall 10 has the oval shape E, a section on a lower part of the piston 1 is a hollow oval column. In general, the hollow oval column can obtain high rigidity of approximately 10 times that of a hollow circular column and thus, rigidity of the skirt 5 and the side walls 4 is improved.

Moreover, when the combustion pressure is received, the deformation amount of the piston 1 to the outer side direction can be reduced for the side walls 4 on the lower end side of the piston 1. That is, a situation in which the closer they are to the lower part of the skirt 5, the more the deformation regions of the side walls 4 are widened to the outer side direction of the piston 1, that is, in an inverted V-shape, can be suppressed.

Moreover, as illustrated in FIG. 2, the short axis of the oval shape E of the inner wall 10 in this embodiment is orthogonal to the pin boss axis C1. By configuring as above, when the skirt 5 receives the combustion pressure, the force is received in the short axis direction. As a result, the oval column having the horizontal section made of an oval curve and extending in a vertical direction has a characteristic of bearing a pressure in a wider range as compared with a circular column extending in the vertical direction with respect to the force in the short axis direction. Thus, in the case of deformation by receiving a force in the short axis direction, the deformation stops in the vicinity of a long axis without spreading to a wide range. Thus, a range of deformation of the side wall 4 in the outer side direction is set mainly to a side closer to the skirt 5 than a long axis X1, that is, to a side closer to the skirt 5 than before, and moreover, the range of deformation becomes a narrow range as compared with previously having a substantially circular column.

Moreover, when the combustion pressure is received, the deformation amount to the outer side direction of the piston 1 can be reduced for the side wall 4 on the lower end side of the piston 1.

Moreover, as illustrated in FIG. 2, a distance L1 between the pin boss axis C1 and the long axis X1 of the oval shape E is larger than a distance L2 between a skirt tangent H in contact with an outer wall surface of the skirt 5 and in parallel with the pin boss axis C1 and the long axis X1 of the oval shape E. By configuring as above, a gravity center axis (long axis X1) of the oval shape E is set closer to the skirt 5 than the pin boss axis C1. The range of deformation of the side wall 4 to the outer side direction (deformation range of the side wall 4) can be set closer to the skirt 5.

Figure 3:
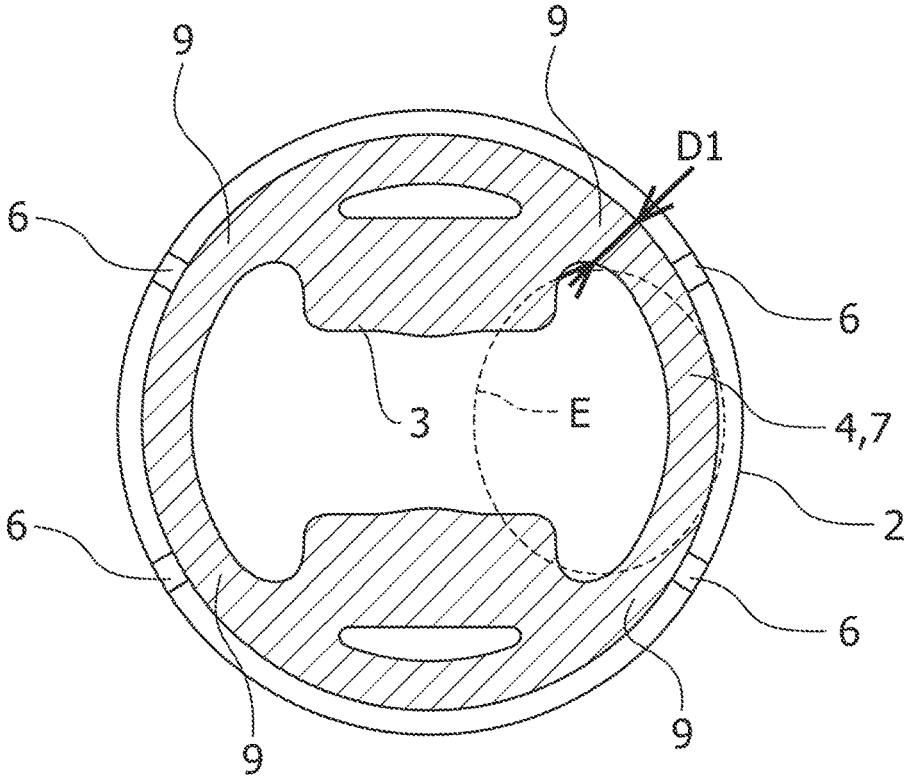
FIG. 3 is an A2-A2 sectional view of FIG. 1.
Figure 4:
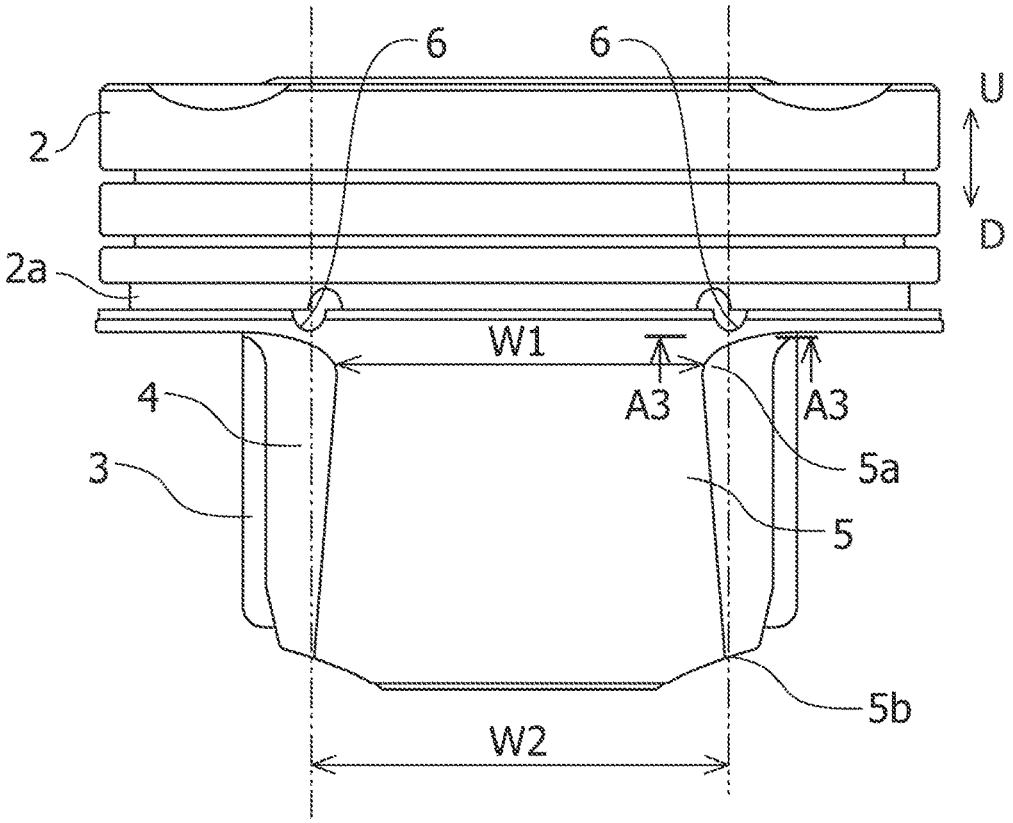
FIG. 4 is a side view of the piston in FIG. 1 when seen from the right.

Moreover, as illustrated in FIGS. 1, 3, and 4 a connecting portion 7 is provided between the piston head 2 and the side wall 4. The connecting portion 7 is provided on a lower part of the oil ring groove 2*a*. A wall thickness D1 of the connecting portion 7 in the radial direction of the side wall 4 located immediately above the long axis X1 of the oval shape E is smaller than a wall thickness in the long axis direction. That is, a thin portion 9 with a smaller wall thickness in the radial direction is provided in the side wall 4 at a position corresponding to the connecting portion 7.

Figure 6A:
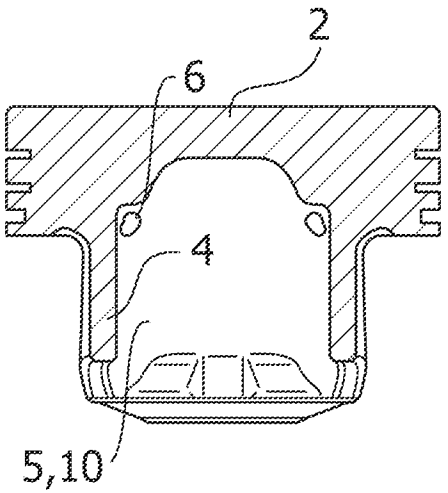
Figure 6B:
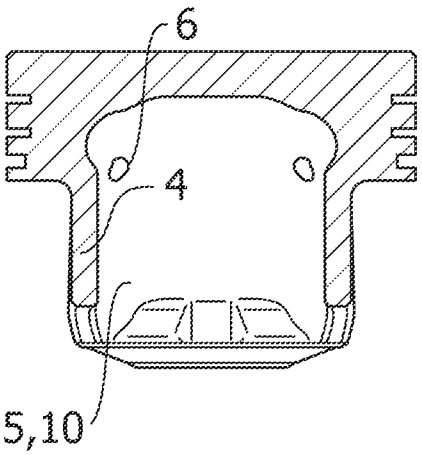
Figure 6C:
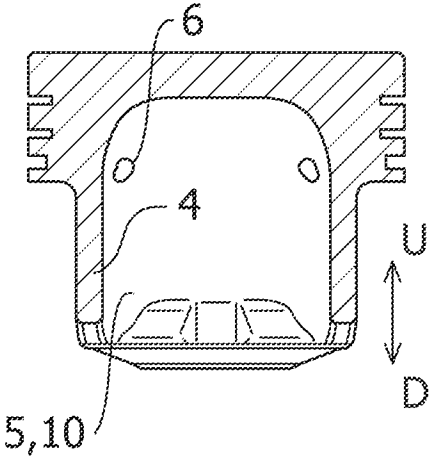

A horizontal width inside the piston 1 on the upper side of a through hole 6, which will be described later, provided on the connecting portion 7, is formed so as to be smaller on a part closer to the pin boss axis C1 illustrated in FIG. 6A, and to be larger on a part farther from that illustrated in FIG. 6C in comparison with a horizontal width at the position corresponding to the long axis X1 illustrated in FIG. 6B.

By providing the thin portion 9 on the long axis X1, which is an axis of deformation in the short axis direction, rigidity of the connecting portion 7 can be reduced. As a result, the deformation amount on the connecting portion 7, that is, on a skirt upper end 5*a*, can be increased, and a difference in the deformation amount between upper and lower parts of the skirt 5 can be reduced.

Moreover, as illustrated in FIG. 2, in this embodiment, an intersection Q1 between a center line C2 passing through wall thickness centers of the side wall 4 and the skirt 5 and a center line C3 (reference line) passing through a wall thickness center of the pin boss 3 located on the outer side of the pin hole 3*a* is set to outer sides of foci S1 and S2 of the oval shape E in the direction of the pin boss axis C1 (direction in which the two foci S1 and S2 are separated from each other). Here, the center line C2 passing through the wall thickness center of the skirt 5 is a curved line passing through center positions of the outer wall of the skirt 5 and the like and the inner wall 10. Moreover, the center line C3 passing through the wall thickness center of the pin boss 3 indicates a center of a distance from an opening edge of the pin hole 3*a* to an end of the pin boss 3 on the outer wall surface of a portion protruding from the side wall 4.

Figure 5:
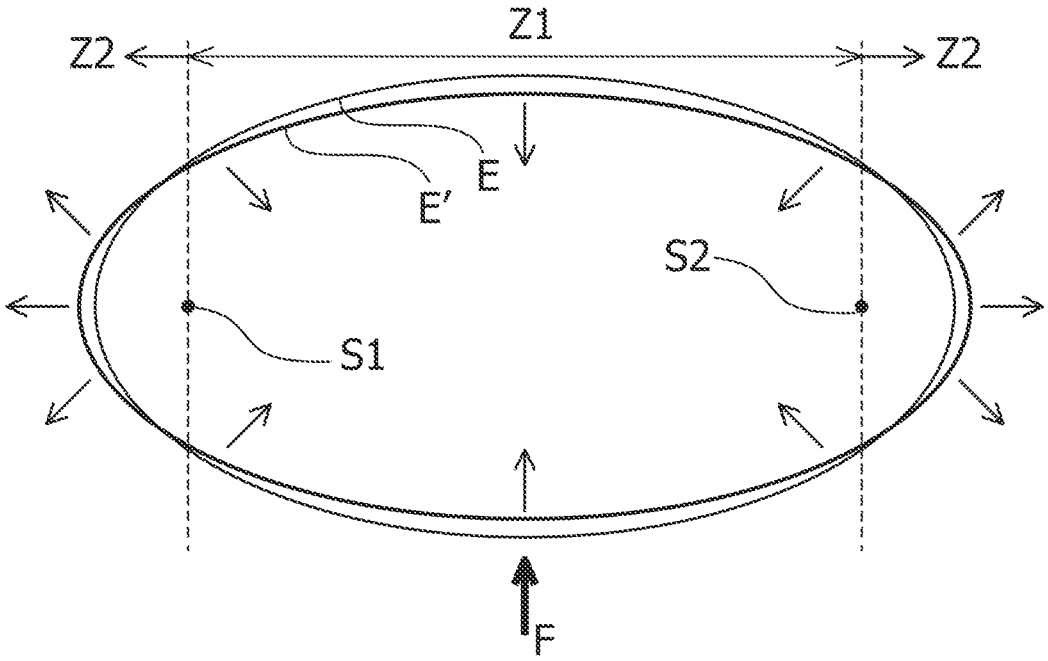
FIG. 5 is a schematic view illustrating a state of deformation of an oval horizontal section in FIG. 2.

As illustrated in FIG. 5, when a load F from the direction of the short axis X2 acts, the oval shape E is deformed to a shape expressed as an oval shape E'. On the outer side of the piston 1 from the foci S1 and S2 of the oval shape E (outer side in the direction of the long axis X1), the oval curved line E is deformed (positive deformation) to the outer side as indicated by a region of Z2 in FIG. 5. On the other hand, on an inner side of the piston 1 from the foci S1 and S2 (a region indicated by Z1 in FIG. 5), the oval curved line E is deformed to the inner side of the piston 1 (negative deformation). By connecting the side wall 4 and the pin boss 3 by the region Z2 of the deformation to the outer side (positive deformation), the deformation of the side wall 4 to the direction of the piston center O can be suppressed. As a result, an amount of deformation to the direction toward the piston center O of the skirt 5 can be reduced.

As illustrated in FIG. 4, two through holes 6 are provided in the connecting portion 7 provided between the piston head 2 and the side wall 4 in order to lower rigidity. The two through holes 6 are disposed above the skirt upper end 5*a* and are disposed at an interval from each other in a circumferential direction of the piston 1. The interval is set the same as a width W2 of the skirt lower end 5*b*. Here, the width W2 of the skirt lower end 5*b* corresponds to a portion of the widest portion of the lower part in the skirt 5 as illustrated in FIG. 4. Moreover, a width W1 of the skirt upper end 5*a* indicates a distance from a boundary with the side wall 4 to a boundary with the opposite side. The width W2 of the skirt lower end 5*b* is larger than the width W1 of the skirt upper end 5*a*.

A deformation amount of the skirt upper end 5*a* to which the combustion pressure is applied is decreased as it departs from a center position of a piston circumferential region of the skirt 5. However, it is hardly deformed since the side wall 4 is located on a rear side of the piston head 2, and rigidity of the region connecting the connecting portion 7 and the boundary between the skirt 5 and the side wall 4 is higher than the peripheral region. That is, since the rigidity of the skirt upper end 5*a* is high, deformation cannot occur in a wide range to the skirt 5 and the side wall 4.

By providing the through hole 6 in this highly rigid region, and further, by making the width of the skirt upper end 5*a* smaller than the width of the lower end, the through hole 6 is formed at a position at the boundary between the side wall 4 and the skirt 5. As a result, a difference in rigidity between upper and lower parts of the skirt 5 can be made smaller.

Figure 7:
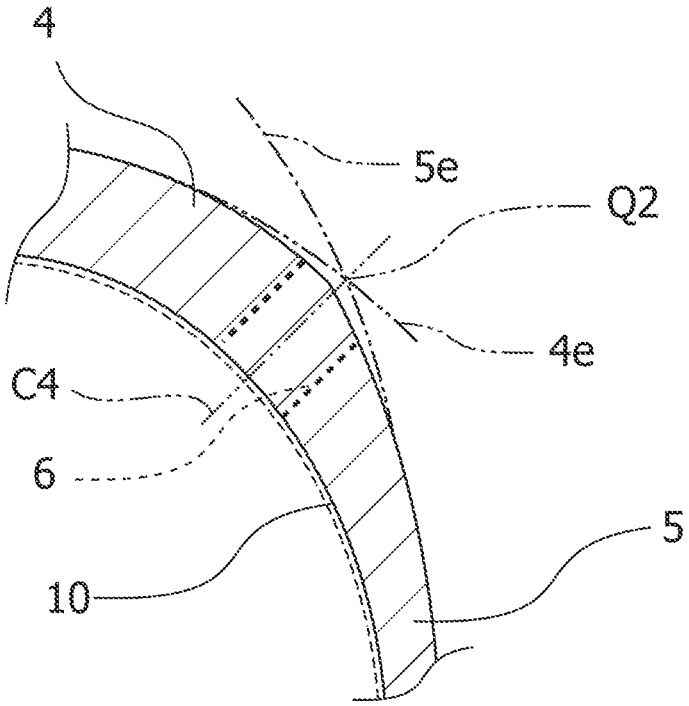
FIG. 7 is an A3-A3 sectional view of FIG. 4.

As illustrated in FIG. 7, the center line C4 extending in penetrating directions of the two through holes 6 is set to cross an intersection Q2 between an extension 5*e* obtained by extending an outer peripheral surface of the skirt 5 toward the side wall 4 and an extension 4*e* obtained by extending the outer peripheral surface of the side wall 4 toward the skirt 5.

By setting as above, the rigidity of the connecting portion 7 is reduced, and the difference in the deformation amount between the upper and lower ends of the skirt 5 can be decreased. As a result, a tilting angle of the piston 1 and a contact planar pressure of the cylinder are suppressed, and a friction loss is reduced.

The description of this embodiment is exemplification for describing the present invention and does not limit the invention as claimed in the claims. Moreover, configuration of each portion of the present invention is not limited to the aforementioned embodiment, and various modifications are possible within the technical scope as claimed in the claims.

Figure 8A:
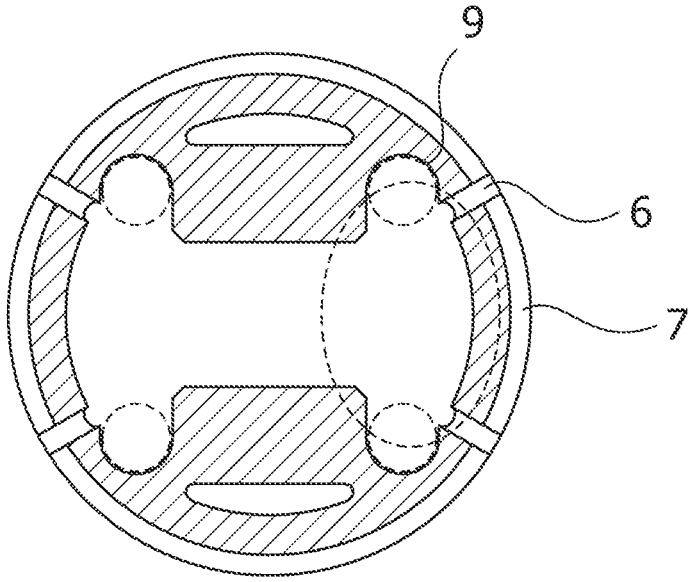
Figure 8B:
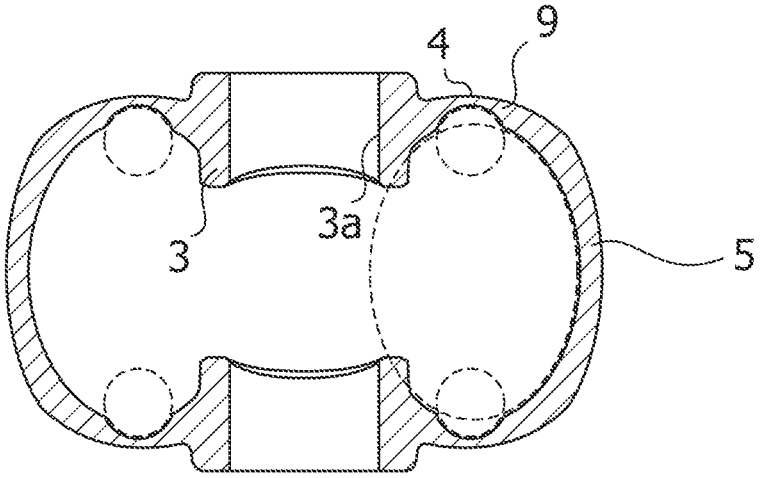
Figure 8C:
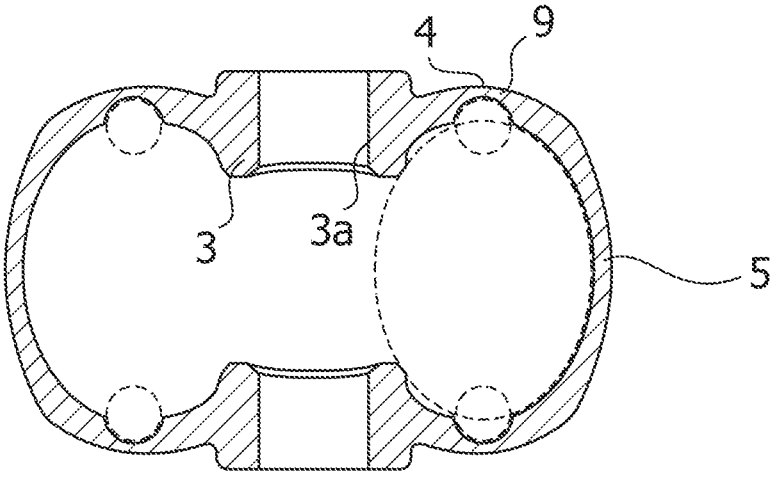

For example, as illustrated in FIGS. 8A to 8C, the thin portion 9 may be provided so as to extend in the vertical direction in the inner wall 10 of the side wall 4. In this case, the thin portion 9 is connected vertically on the gravity center line (position corresponding to the long axis X1) from a position illustrated in FIG. 8A toward a section illustrated in FIG. 8C via a section illustrated in FIG. 8B. In this case, the thin portion 9 on the skirt lower end 5*b* illustrated in FIG. 8C is smaller than the thin portion 9 illustrated in FIG. 8A. The thin portion 9 becomes larger as it goes to the upper side. As a result, the aforementioned rigidity difference in the skirt 5 in the vertical direction is made smaller, and the vertical deformation in the skirt 5 can be made smaller.

REFERENCE SIGNS LIST

1 piston
1*a* piston pin
2 piston head
2*a* oil ring groove
3 pin boss
3*a* pin hole
4 side wall
5 skirt
5*a* skirt upper end
5*b* skirt lower end
6 through hole
7 connecting portion
9 thin portion
10 inner wall

The invention claimed is:

1. A piston for an internal combustion engine having two pin bosses provided on a lower surface of a piston head so as to face each other at an interval, a side wall provided on the lower surface of the piston head and disposed on both sides of each of the pin bosses, and a skirt provided continuing to the side wall, a pin hole into which a piston pin can be inserted being formed in each of the two pin bosses, wherein inner walls of the side walls and the skirt are continuous with each other, the inner walls are disposed by facing each other on both sides of a pin boss axis with the pin boss axis connecting centers of the two pin holes between them;

a horizontal section of each of the inner walls is formed along a specific oval shape;

two through holes are provided in a connecting portion provided between the piston head and the side wall, the two through holes are disposed above an upper end of the skirt at an interval from each other, and the interval is set the same as a width of a lower end of the skirt; and the two through holes are arranged on respective perpendicular imaginary lines extending from the skirt lower end in the direction perpendicular to the axis of the piston pin.

2. The piston for an internal combustion engine according to claim 1, wherein a short axis of the oval shape is orthogonal to the pin boss axis.

3. The piston for an internal combustion engine according to claim 1, wherein a distance between the pin boss axis and a long axis of the oval shape is longer than a distance between a skirt tangent in contact with an outer wall of the skirt and in parallel with the pin boss axis and the long axis of the oval shape.

4. The piston for an internal combustion engine according to claim 3, wherein a connecting portion is provided between the piston head and the side wall; and a wall thickness of the connecting portion in a piston radial direction of the side wall located immediately above the long axis of the oval shape is smaller than a wall thickness in the long axis direction.

5. The piston for an internal combustion engine according to claim 1, wherein an intersection between a reference line passing through a center of a horizontal thickness of a wall portion of the pin boss adjacent to the pin hole and in parallel with the pin boss axis and a center line passing through a wall thickness center of the skirt is set to an outer side of a focus of the oval shape in a pin boss axis direction.

6. The piston for an internal combustion engine according to claim 1, wherein a first imaginary line obtained by extending an outer peripheral surface of the skirt toward the sidewall and a second imaginary line obtained by extending an outer peripheral surface of the sidewall toward the skirt so as to intersect the first imaginary line are set;

a center line of each of the through holes is set to cross an intersection between the first imaginary line and the second imaginary line; and the width of an upper end of the skirt is set smaller than a distance between the centers of the two through holes.

* * * * *